US005690079A

United States Patent [19]

Craig

[11] Patent Number: 5,690,079

[45] Date of Patent: Nov. 25, 1997

[54] APPARATUS FOR ENHANCING FUEL EFFICIENCY OF A VEHICLE

[76] Inventor: Douglas R. Craig, 427 Ash St., Henderson, Nev. 89015

[21] Appl. No.: 653,455

[22] Filed: May 24, 1996

Related U.S. Application Data

[63] Continuation-in-part of Ser. No. 394,252, Feb. 24, 1995, abandoned.

[51] Int. Cl.[6] ..... F02M 27/04

[52] U.S. Cl. ..... 123/538

[58] Field of Search ..... 123/536, 537, 123/538, 539; 210/222, 695

[56] References Cited

U.S. PATENT DOCUMENTS 4,461,262 7/1984 Chow ..... 123/538

4,572,145 2/1986 Mitchell et al. ..... 123/538

5,124,045 6/1992 Janczak et al. ..... 123/538

*Primary Examiner*—Marguerite McMahon

*Attorney, Agent, or Firm*—Leonard Weiss

[57] ABSTRACT

A pair of intake magnets are connected to jaws of an intake spring clip that clamp onto an intake line of a fuel injector of a motor vehicle. The pair of intake magnets have their north poles downstream of their south poles. Additionally, a plurality of intake magnets may be connected to the jaws of the intake spring clip with their poles aligned perpendicularly to a central axis of the intake line. Two pairs of return magnets are connected to jaws of a return spring clip that clamp onto a return line of the fuel injector. Each of the return magnets has its north pole upstream of its south pole. Ends of a coil spring are respectively connected to the intake and return spring clips. The coils of the spring are around two crossover magnets that have their north poles closer to the fuel injector than their south poles.

7 Claims, 3 Drawing Sheets

APPARATUS FOR ENHANCING FUEL EFFICIENCY OF A VEHICLE

This is a continuation-in-part application of prior application Ser. No. 08/394,252, filed Feb. 24, 1995, abandoned. efficiency. However, the enhancement of the fuel efficiency is usually low because only magnets that are disposed about and adjacent to the intake line are utilized.

SUMMARY OF THE INVENTION

An object of the present invention is to enhance the fuel efficiency of a motor vehicle.

According to one aspect of the present invention, an intake magnet and a return magnet are disposed proximal to intake and return lines, respectively, of a fuel injector of a gasoline powered motor vehicle. A crossover magnet is disposed between the intake and the return lines. The intake magnet has its north pole downstream of its south pole. The return magnet has its north pole upstream of its south pole. The crossover magnet has its north pole closer than its south pole to the fuel injector.

According to another aspect of the present invention, an intake magnet is disposed proximal to an intake line of a carburetor of the vehicle. A return magnet is connected to the chassis of the vehicle. A crossover magnet is disposed between the intake and return magnets. The intake magnet has its north pole downstream of its south pole. The crossover magnet has its north pole closer than its south pole to the carburetor.

The present invention provides an economical assembly of permanent magnets that enhances fuel efficiency of an automobile more than attainable by other known assemblies.

Other objects, features, and advantages of the invention will be apparent from the following description of the preferred embodiment as illustrated in the accompanying drawing.

DESCRIPTION OF THE EMBODIMENTS

Figure 1:
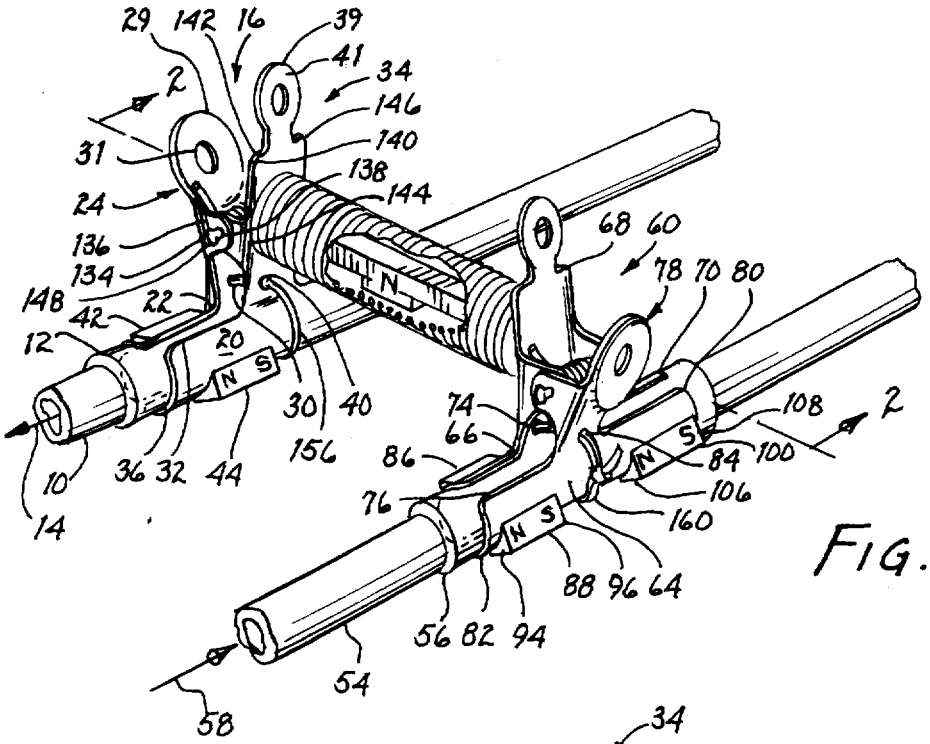
FIG. 1 is a perspective view of a first embodiment of the present invention.
Figure 2:
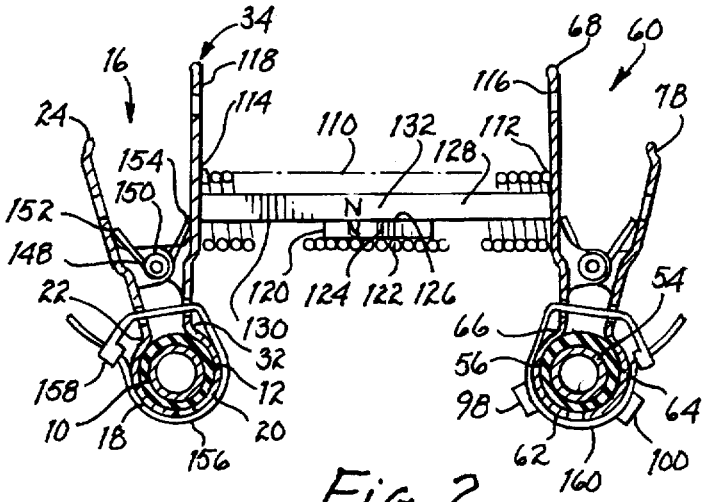
FIG. 2 is a section of FIG. 1 taken along the line 2—2.
Figure 3:
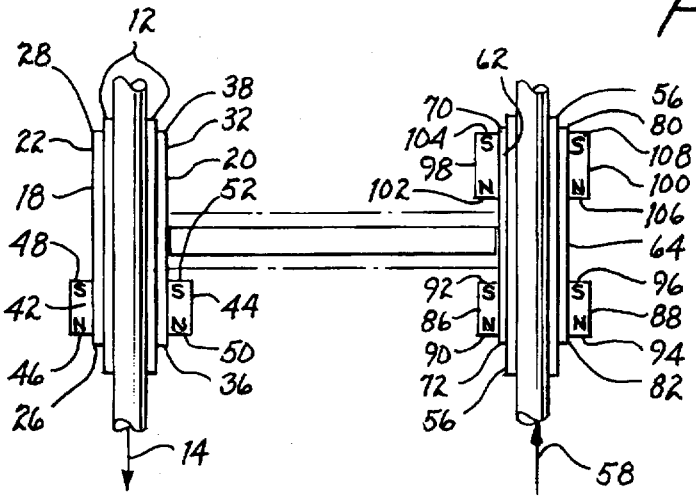
FIG. 3 is a plan view, with parts broken away, of the embodiment of FIG. 1.

As shown in FIGS. 1–3, in a first embodiment of the present invention, a gasoline powered motor vehicle has a fuel intake line that preferably passes through a protective sponge rubber sleeve 12. Intake line 10 is connected to a fuel injector (not shown). When the engine of the vehicle is in operation, gasoline flows downstream in the direction of an arrow 14 through intake line 10 to the fuel injector.

A spring clip 16, has similar jaws 18, 20 that clamp onto sleeve 12. Because of sleeve 12, edges of jaws 18, 20 do not abrade, and possibly damage, line 10. The clamping of jaws 18, 20 is more fully described hereinafter.

Jaw 18 has an upper edge 22 that is integrally connected to a proximal end of a handle 24. The connection to handle 24 is approximately midway between a downstream edge 26 and an upstream edge 28 (FIG. 3) of jaw 18. Handle 24 is of a generally rectangular shape with a rounded distal end 29 and a hole 30 through its proximal end (FIG. 1). Distal end 29 has a hole 31 therethrough that facilitates the manipulation of handle 24.

Jaw 20 has an upper edge 32 that is integrally connected to a proximal end of a handle 34. The connection to handle 34 is approximately midway between a downstream edge 36 and an upstream edge 38 (FIG. 3) of jaw 20. Like handle 24, handle 34 is of a generally rectangular shape with a rounded distal end 39 and a hole 40 through its proximal end (FIG. 1).

The axes of holes 30, 40 are in approximate alignment. The use of holes 30, 40 is described more fully hereinafter.

In this embodiment, handle 34 is longer than handle 24. Additionally, distal end 39 has a hole 41 therethrough that facilitates the manipulation of handle 34.

Intake bar magnets 42, 44 are respectively connected in any suitable manner to jaws 18, 20, downstream of holes 30, 40. Magnet 42 is disposed with its north pole 46 downstream of its south pole 48. Similarly, magnet 44 is disposed with its north pole 50 downstream of a south pole 52.

In a first series of evaluation experiments, it was determined that the above-described connection of magnets 42, 44 to line 10 results in an approximately 3.5% increase in miles per gallon obtained in usage of the vehicle.

It is believed that as fuel flows through line 10, it is ionized by the fields of magnets 42, 44. The ionization causes hydrocarbons of the fuel to acquire a net positive charge that results in hydrocarbon molecules that readily bond with negatively charged oxygen molecules. Additionally, the fields of magnets 42, 44 cause the fuel to dissolve unwanted carbon build ups.

In this embodiment, magnets 42, 44 are a ferrite based ceramic with a lift rating of two ounces. Additionally, magnets 42, 44 have a length of % inch and a square cross section of ¼ inch on a side. It should be understood that the strength and size of magnets 42, 44 is not of critical importance.

The vehicle additionally has a fuel return line 54 that preferably passes through a protective sponge rubber sleeve 56 for reasons similar to those given in connection with sleeve 12. Sleeve 56 is similar to sleeve 12.

Return line 54 is connected to the fuel injector. When the vehicle is in operation, gasoline flows downstream in the direction of an arrow 58 through return line 54 from the fuel injector.

A spring clip 60, similar to clip 16, has jaws 62, 64 that clamp onto sleeve 56. The clamping of jaws 62, 64 is more fully described hereinafter.

Jaw 62 has an upper edge 66 that is integrally connected to a proximal end of a handle 68 that is similar to handle 34. The connection to handle 68 is approximately midway between a downstream edge 70 and an upstream edge 72 (FIG. 3) of jaw 62. Handle 68 has a hole 74 through its proximal end (FIG. 1).

Jaw 64 has an upper edge 76 that is integrally connected to a proximal end of a handle 78 that is similar to handle 24. The connection to handle 78 is approximately midway between a downstream edge 80 and an upstream edge 82 (FIG. 3) of jaw 64. Handle 78 has a hole 84 through its proximal end (FIG. 1).

The axes of holes 74, 84 are in approximate alignment. The use of holes 74, 84 is described more fully hereinafter.

Return bar magnets 86, 88 are respectively connected in any suitable manner to jaws 62, 64, upstream of holes 74, 84. Magnet 86 is disposed with its north pole 90 upstream of its south pole 92. Similarly, magnet 88 is disposed with its north pole 94 upstream of its south pole 96. Magnets 86, 88 are similar to magnets 42, 44 described hereinbefore.

In addition to magnets 86, 88, return bar magnets 98, 100 are fixedly connected in any suitable manner to jaws 62, 64, respectively, downstream of holes 74, 84. Magnet 98 is disposed with its north pole 102 upstream of its south pole 104. Similarly, magnet 100 is disposed with its north pole 106 upstream of its south pole 108.

Magnets 98, 100 are a ferrite based ceramic with a lift strength of 0.7 ounces. Additionally, magnets 98, 100 have a length of one inch and a square cross section of ¼ inch on a side. The strength and size of magnets 98, 100 is not of critical importance.

A coil spring 110 has a proximal end 112 and a distal end 114 fixedly connected in any suitable manner to handle 68 at a surface 116 and to handle 34 at a surface 118, respectively. Because of spring 110, there is a variable displacement between clips 16, 60 that makes the invention amenable for use in almost all gasoline powered vehicles.

A crossover bar magnet 120 is disposed within spring 110. Magnet 120 is a ferrite based ceramic with a lift rating of 0.7 ounces. Additionally, magnet 120 has a length of approximately 0.9 inches and a square cross section of approximately ¼ inch on a side. The strength and size of magnet 120 is not of critical importance.

A bottom face 122 of magnet 120 is adhesively connected to spring 110 approximately midway between ends 112, 114. Magnet 120 has a north pole at a side face 124 thereof. A side face, opposite face 124 (not shown) is a south pole of magnet 120. Accordingly, magnet 120 is disposed with its north pole closest to the fuel injector.

A top face 126 of magnet 120 is adhesively connected to a crossover bar magnet 128 at a bottom face 130 thereof. Magnet 128 has a lift rating of 0.8 ounces. Additionally, magnet 128 has a length of 2 inches and a ½ inch×¼ inch rectangular cross section. The strength and size of magnet 128 is not of critical importance.

Magnet 128 has a north pole at a 2 inch×¼ inch side face 132 thereof. A side face (not shown), opposite face 132, is a south pole of magnet 128. Accordingly, magnet 128 is disposed with its north pole closest to the fuel injector.

It should be understood that the size of magnets 120, 128 are selected to fill a substantial portion of the interior of spring 110, thereby enhancing mechanical stability of magnets 120, 128 within spring 110.

An edge 134 of handle 24 is integrally connected perpendicularly to a hinge bracket 136 that has a hole 138 therethrough. A hinge bracket, similar to bracket 136, is integrally connected perpendicularly to an edge 140 of handle 24.

Similarly, an edge 142 of handle 34 is integrally connected perpendicularly to a hinge bracket 144 with a hole (not shown) therethrough. A hinge bracket, similar to bracket 144, is integrally connected perpendicularly to an edge 146 of handle 34.

Brackets of handle 24 overlap brackets of handle 34 with all the holes therethrough in alignment. A shaft 148 passes through the bracket holes. Ends of shaft 148 are enlarged, whereby shaft 148 is maintained within the bracket holes.

A coil spring 150 is wound around shaft 148. Spring 150 has ends 152, 154 that press against handles 24, 34, respectively (FIG. 2). Because ends 152, 154 press against handles 24, 34, jaws 18, 20 clamp onto sleeve 12. In a similar manner, jaws 62, 64 clamp onto sleeve 56.

A plastic strip 156 with a ratchet edge has a pawl 158 at one end. Strip 156 passes through holes 30, 40 and around jaws 18, 20. The other end of strip 156 is passed through pawl 158 and pulled to provide a security tie about jaws 18, 20. In a similar manner, a plastic strip 160 passes through holes 74, 84 to provide a security tie about jaws 62, 64.

In a second series of evaluation experiments, it was determined that use of the apparatus of this embodiment results in an approximately 6% increase in miles per gallon in usage of the vehicle. Because the connection of magnets 42, 44 results in the 3.5% increase in the miles per gallon, the remainder of the 6% increase (2.5%) is caused by magnets 86, 88, 98, 100, 120. It is believed that the ionization of the fuel in line 10 described hereinbefore, is augmented by fields of magnets 86, 88, 98, 100, 120.

In this embodiment, spring clips 16, 60 and spring 110 are made from a ferromagnetic material. In an alternative embodiment, spring clips 26, 60 and spring 110 are made from a non-magnetic material.

Figure 4:
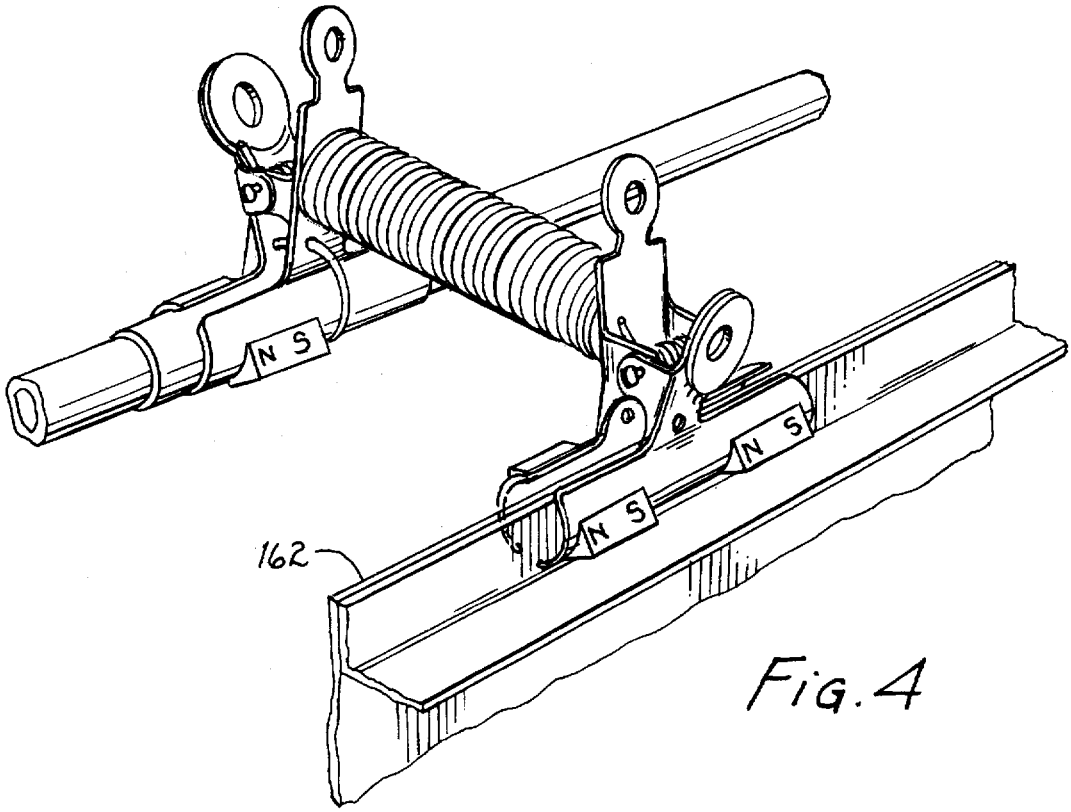
FIG. 4 is a perspective view of a second embodiment of the present invention.
Figure 5:
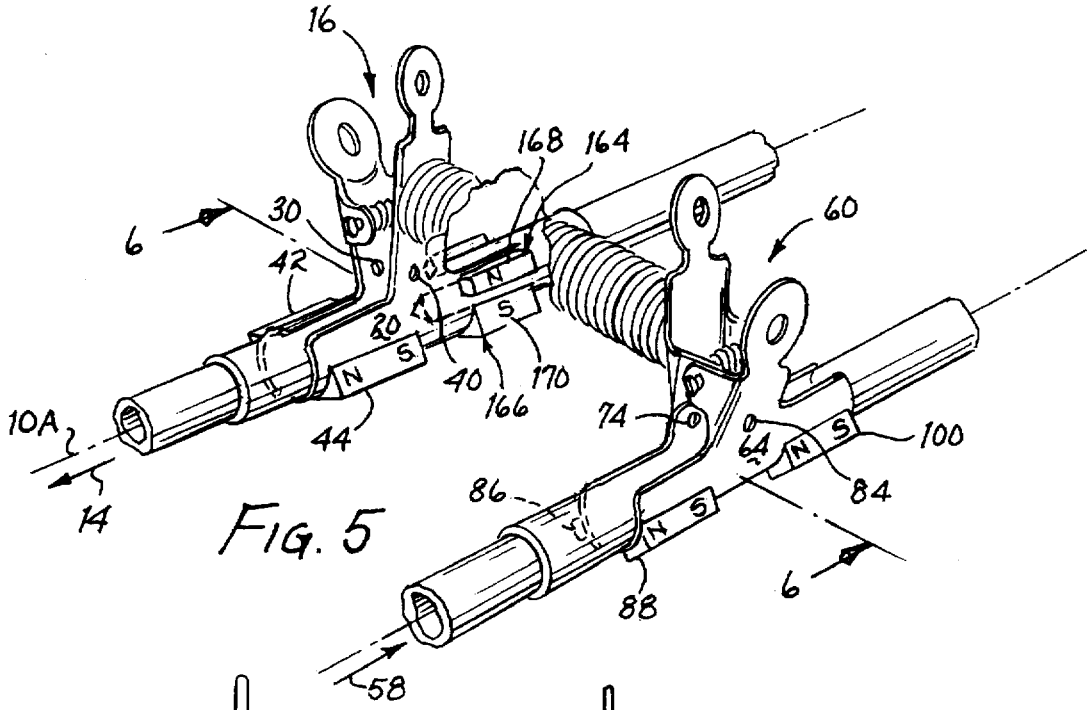
FIG. 5 is a perspective view, with parts broken away, of a third embodiment of the present invention.
Figure 6:
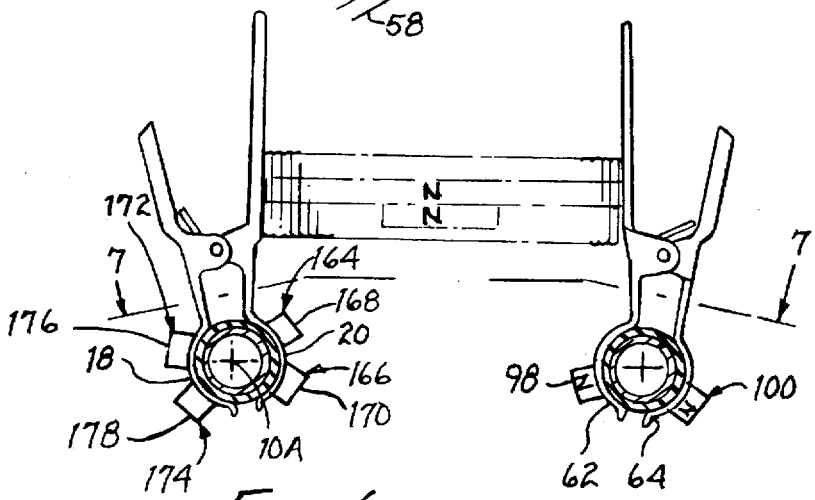
FIG. 6 is a section of FIG. 5 taken along the line 6—6.
Figure 7:
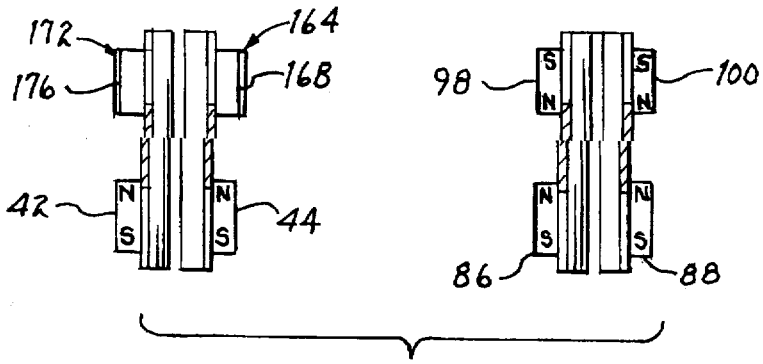
FIG. 7 is a section of FIG. 6 taken along the line 7—7.

In a second embodiment of the present invention, the vehicle includes a carburetor. As shown in FIG. 4, line 10 is connected to the carburetor. Jaws 18, 20 clamp onto line 10 as described hereinbefore. Jaws 62, 64 clamp onto the chassis of the vehicle at a metal flange 162 thereof. Magnets 42, 44, 86, 88, 90, 100, 120 are oriented as described hereinbefore.

In both of the embodiments, it has been experimentally verified that when any of magnets 42, 44, 86, 88, 98, 100, 120 are mounted with polarities other than those disclosed herein, there is a decrease in the fuel efficiency of the vehicle and an increase in an emission of pollutants therefrom.

In a third embodiment of the present invention a first pair of similar intake magnets 164, 166 are mounted upon the jaw 20 upstream of the hole 40. Magnet 164 has its north pole at a face 168 thereof. Therefore, magnet 164 has its south pole substantially in an abutting relationship with jaw 20. Moreover, the poles of magnet 164 are aligned perpendicularly to a central axis 10A of intake line 10.

Magnet 166 has its south pole at a face 170 thereof. Therefore, magnet 166 has its north pole substantially in an abutting relationship with jaw 20. Like magnet 164, the poles of magnet 166 are aligned perpendicularly to axis 10A.

A second pair of bar magnets 172,174, that are similar to the magnets 164,166, are mounted upon the jaw 18 upstream of the hole 30. Magnet 172 has a north pole at a face 176 thereof. Therefore, magnet 172 has its south pole substantially in an abutting relationship with jaw 18. Like magnet 164, the poles of magnet 172 are aligned perpendicularly to axis 10A.

Magnet 174 has a south pole at a face 178 thereof. Therefore magnet 174 has its north pole substantially in an abutting relationship with the jaw 18. Like magnet 164, the poles of magnet 174 are aligned perpendicularly to axis 10A.

It is believed that the magnets 164, 166, 172, 174 further increase the ionization of the hydrocarbons and the dissolution of the unwanted carbon buildups. It was experimentally verified that the use of magnets 164, 166, 172, 174 results in an approximately 3% increase in miles per gallon of gas consumed by a vehicle.

While the invention has been particularly shown and described with reference to a preferred embodiment thereof, it will be understood by those skilled in the art that changes in form and detail may be made therein without departing from the spirit and scope of the invention.

What is claimed is:

1. An apparatus for enhancing the fuel efficiency of a gasoline powered vehicle of the type which has a fuel injector that takes fuel through a fuel intake line and returns fuel through a fuel return line, comprising:

an intake magnet;

means for fixedly disposing said intake magnet on the intake line with the north pole of said intake magnet downstream of its south pole;

a return magnet;

means for fixedly disposing said return magnet proximal to the return line with the north pole of said return magnet upstream of its south pole;

a crossover magnet; and means for disposing said crossover magnet between the intake and return lines with the north pole of said crossover magnet closest to the fuel injector, said crossover disposition means comprising a coil spring that has ends respectively connected to said intake and return disposition means with coils of said spring around said crossover magnet.

2. The apparatus of claim 1 wherein said magnets are comprised of a ferrite based ceramic.

3. The apparatus of claim 1 wherein said intake and return disposition means are comprised of an intake spring clip and a return spring clip, respectively, with jaws of said intake clip clamping onto said intake line and jaws of said return clip clamping onto said return line, said intake and return magnets being connected to said jaws of said intake clip and jaws of said return clip, respectively.

4. The apparatus of claim 3, additionally comprising:

a protective sleeve that fits around said intake line, said jaws of said intake clip clamping onto said intake line sleeve; and a protective sleeve that fits around said return line, said jaws of said return clip clamping onto said return line sleeve.

5. The apparatus of claim 4 wherein said crossover disposition means has ends respectively connected to said intake and return clips with coils of said spring around said crossover magnet, said clips and said spring being made from a magnetic material.

6. An apparatus for enhancing the fuel efficiency of a vehicle of the type which has a fuel injector that takes fuel through a fuel intake line and returns fuel through a fuel return line, comprising:

an intake magnet connected to said intake line with its north pole downstream of its south pole;

a return magnet connected to said return line with its north pole upstream of its south pole;

a plurality of intake magnets connected to said intake line with their poles aligned perpendicularly to a central axis of said intake line;

a crossover magnet disposed between the intake and return lines with the north pole of said crossover magnet closest to the fuel injector.

7. The apparatus of claim 6 wherein said intake line is adapted for connection to a spring clip, said plurality of intake magnets comprising:

a first intake magnet with its south pole connected in an abutting relationship to a jaw of said spring clip; and a second intake magnet with its north pole connected in an abutting relationship to said jaw.

* * * * *